US006153366A

United States Patent [19]

Arai

[11] Patent Number: 6,153,366

[45] Date of Patent: Nov. 28, 2000

[54] SILVER HALIDE PHOTOGRAPHIC LIGHT-SENSITIVE MATERIAL

[75] Inventor: Takeo Arai, Hino, Japan

[73] Assignee: Konica Corporation, Japan

[21] Appl. No.: 09/104,806

[22] Filed: Jun. 25, 1998

[30] Foreign Application Priority Data

Jul. 1, 1997 [JP] Japan ..... 9-175688

[51] Int. Cl.[7] ..... G03C 1/81; G03C 1/93; G03C 1/765

[52] U.S. Cl. ..... 430/496; 430/537; 430/539; 430/961

[58] Field of Search ..... 430/537, 539, 430/950, 961, 496

[56] References Cited

U.S. PATENT DOCUMENTS

| | | | |
|---|---|---|---|
| 4,232,117 | 11/1980 | Naoi et al. | 430/539 |
| 4,264,719 | 4/1981 | Kameoka et al. | 430/537 |
| 4,396,709 | 8/1983 | Kameoka et al. | 430/539 |
| 4,914,012 | 4/1990 | Kawai | 430/537 |
| 4,952,960 | 8/1990 | Kosugi et al. | 354/299 |
| 5,219,718 | 6/1993 | Hatakeyama et al. | 430/539 |
| 5,681,688 | 10/1997 | Takamuki | 430/537 |
| 5,800,972 | 9/1998 | Kotani et al. | 430/537 |

FOREIGN PATENT DOCUMENTS 0823656 11/1998 European Pat. Off. .

OTHER PUBLICATIONS

European Search Report EP 98 30 5169.

Patent Abstracts of Japan, Publication #07248572, Publication date: Sep. 26, 1995.

*Primary Examiner*—Richard L. Schilling

*Attorney, Agent, or Firm*—Jordan B. Bierman; Bierman, Muserlian and Lucas

[57] ABSTRACT

A silver halide photographic light-sensitive material IS DISCLOSED. The light-sensitive material comprises a support, a silver halide emulsion layer provided on one side of the support, and a non-light-sensitive hydrophilic colloid layer provided on the other side of the support, in which the non-light-sensitive hydrophilic colloid layer comprises a polymer latex and gelatin and the weight ratio of the polymer latex to gelatin is from 0.5 to 3.0.

3 Claims, No Drawings

SILVER HALIDE PHOTOGRAPHIC LIGHT-SENSITIVE MATERIAL

FIELD OF THE INVENTION

This invention relates to a black-and-white silver halide photographic light-sensitive material, and particularly relates to the dimension stability of a silver halide photographic light-sensitive material for photomechanical use.

BACKGROUND OF THE INVENTION

Recently, a laser exposing apparatus so called an image setter is populated in the field of light-sensitive material for photomechanical output. When the exposure device of the exposing apparatus is a drum, it is usual that the silver halide photographic light-sensitive material, hereinafter simply referred to a light-sensitive material, is automatically rewound from the bulk roll and provided on the drum, and then fixed on the drum by vacuum suction and exposed to light.

In a practical case, the operating condition such as the period for exposure and the period from the completion of exposure to the start of next exposure are variously changed. The dimension of the light-sensitive material is frequently varied during the period in which the light-sensitive material is fixed by vacuum on the drum. Consequently, dimensions of the output images for yellow, magenta, cyan and black plates for color printing tend to differ from each other when one of the light-sensitive material is fixed for a prolonged time on the drum, even though the dimension of the four images have to the same.

Regarding the dimension stability of light-sensitive material, a technique for raising the dimension stability by improving the coating and drying conditions of the light-sensitive material has been disclosed in Japanese Patent Publication Open for Public Inspection, hereinafter referred to JP O.P.I., No. 1-130153. JP O.P.I. Nos. 1-315745, 2-108051 and 2-266355 disclose a technique for stabilizing the dimension from the viewpoint of the automatic processor.

However, these known techniques are the dimension stabilizing method for responding to change of dimension caused by the variation of the temperature and humidity of the environment and the condition of the automatic processor. The dimension stability relating the variation of the period of vacuum suction is not considered in these techniques, which is the object of the invention. Accordingly, further improvement has been demanded.

SUMMARY OF THE INVENTION

Consequently, the object of the invention is to provide a silver halide photographic light-sensitive material which is stabilized in the dimension preciseness when the light-sensitive material is fixed by suction on the drum for exposure to light such as that of a laser image setter.

The above-mentioned object of the invention is attained by a silver halide photographic light-sensitive material comprising a support, a silver halide emulsion layer provided on one side of the support, and a non-light-sensitive hydrophilic colloid layer provided on the other side of the support, in which the non-light-sensitive hydrophilic colloid layer comprises a polymer latex and gelatin in a weight ratio of the polymer latex to gelatin of from 0.5 to 3.0.

DETAILED DESCRIPTION OF THE INVENTION

In the invention, the non-light-sensitive hydrophilic colloid layer is a hydrophilic colloid layer provided on the side of the light-sensitive material on which no substantially light-sensitive silver halide grain is provided. In concrete, the layer, hereinafter referred to a BC layer, includes a backing layer and a protective layer or a non-light-sensitive hydrophilic colloid layer adjacent to the backing layer which are coated on the surface of the support opposite to the surface of the support on which the silver halide emulsion layer.

In the invention, the BC layer comprises gelatin and a polymer latex.

A known polymer latex is usable without any limitation in the BC layer, and that having an average particle diameter of from 0.001 to 3.0 $\mu$m is preferred. A polymer latex having a Tg of from −100° C. to 150° C. is preferable. There is no limitation on the kind of monomer constituting the polymer latex.

The latexes preferably unable in the invention are as follows: for example, a homopolymer of alkyl methacrylate such as methyl methacrylate and ethyl methacrylate, a homopolymer of styrene, a copolymer of an alkyl methacrylate or styrene and an alkyl acrylate, N-methylolacrylamide or glycidol methacrylate, a homopolymer of an alkyl acrylate such as methyl acrylate, ethyl acrylate and butyl acrylate, a copolymer of an alkyl acrylate and acrylic acid or N-methylolacrylamide in which the content of copolymerizable monomer such as acrylic acid is preferably not more than 30% by weight, a homopolymer of butadiene, a copolymer of butadiene and one or more of styrene, butoxymethylacrylamide and acrylic acid, and a three component copolymer of vinylidene chloride, methyl acrylate and acrylic acid.

Concrete examples of polymer latex preferably usable in the invention are described below.

Examples of latex

L-1

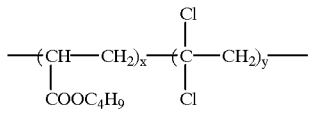

(x/y = 50/50)

L-2

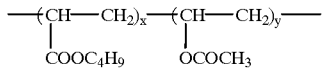

(x/y = 50/50)

-continued
L-3
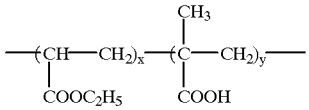
(x/y = 95.6/4.4)
L-4
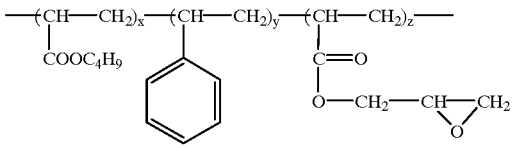
(x/y/z = 40/20/40)
L-5
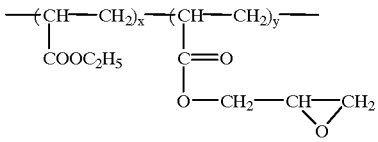
(x/y = 50/50)
L-6
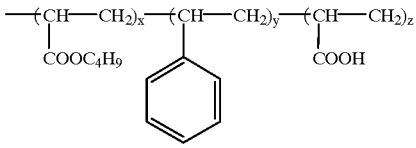
(x/y/z = 39.4/59/1.6)
L-7
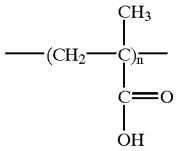
R:—$CH_3$, $C_2H_5$, or $C_4H_9$
L-8
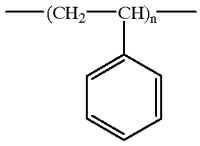
L-9
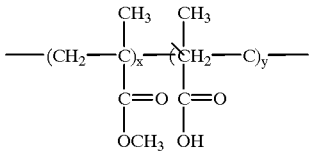
(x/y = 93/7)
L-10
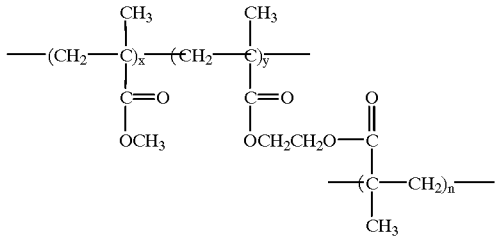
(x/y = 93/7)

-continued
L-11
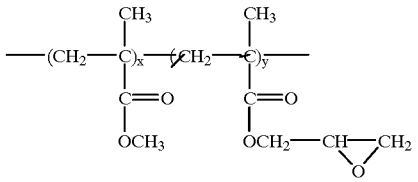
(x/y = 93/7)
L-12
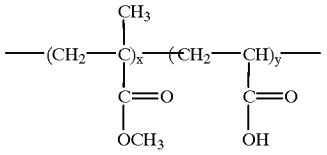
(x/y = 93/7)
L-13
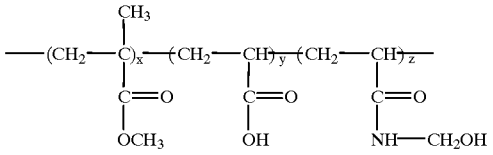
x/y/z = 93/3/4
L-14
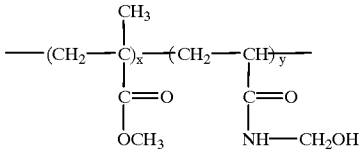
x/y = 93/7
L-15
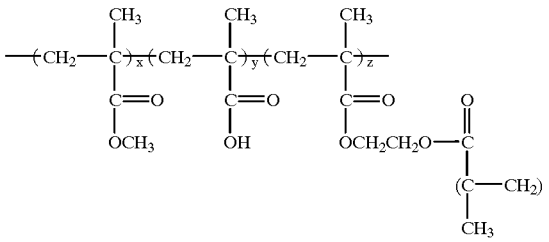
x/y/z = 93/3/4
L-16
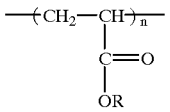
R: $CH_3$, $C_2H_5$, $C_4H_9$
L-17
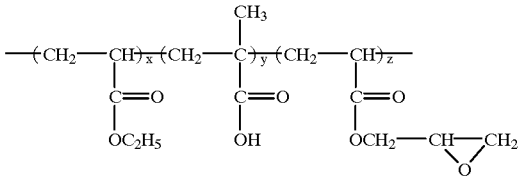
(x/y/z = 93/3/4)

-continued

L-18

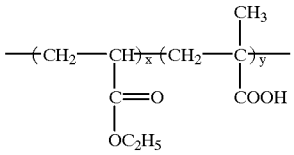

(x/y = 93/7)

L-19

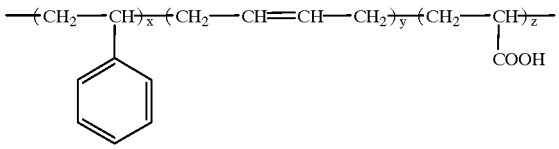

(x/y/z = 59/39/2)

L-20

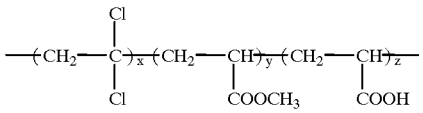

(x/y/z = 85/13/2)

L-21

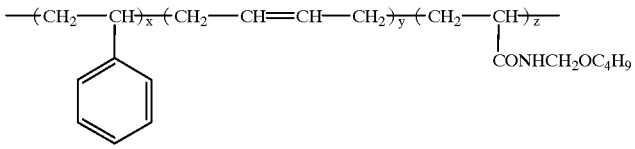

(x/y/z = 64/33/3)

L-22

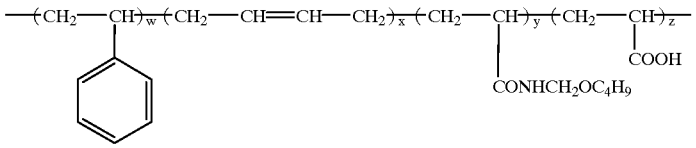

(w/x/y/z = 63/32/3/2)

L-23

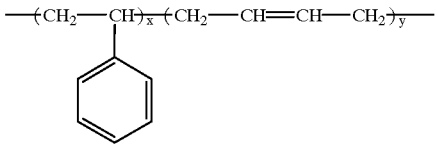

(x/y = 67/33)

L-24

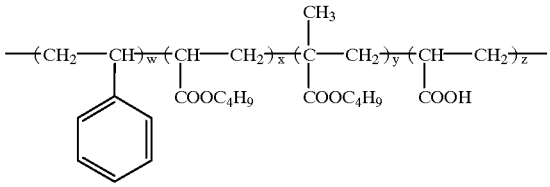

(w/x/y/z = 45/43/8/4)

In the above-mentioned, X/Y, X/Y/Z or W/X/Y/Z shows the molar ratio of the repeating units in percent.

In the invention, the above-mentioned polymer latexes and a polymer latex polymerized in the presence of gelatin described in JP O.P.I. No. 4-359245 are preferably usable. In such the case, the amount of gelatin bonded with the latex polymer is included in the amount of gelatin defined in the invention.

In the invention, a composite latex composed of an inorganic particle and a hydrophobic polymer may also be contained in the non-light-sensitive hydrophilic colloid layer. In such the case, the amount of the hydrophilic polymer of the composite latex is counted as the amount of the polymer latex according to the invention.

Hydrophobic monomers for composing the hydrophobic polymer of the composite latex usable in the invention are one or 2 or more selected from an acrylic acid ester, a methacrylic acid ester, a vinyl ester, an olefin, a styrene, a crotonic acid eater, an itaconic acid diester, a maleic acid diester, a fumalic acid diester, an ally compound, a vinyl ether, a vinyl ketone, a vinyl heterocyclic compound, a glycidyl ester, an unsaturated nitrile and various kinds of unsaturated acid. As the hydrophobic monomer for composing the hydrophobic polymer of the invention, an acrylic acid ester and/or methacrylic acid ester, and styrene are preferred, and the carbon number of the ester group is preferably 6 or more.

It is preferred to use a hydrophobic monomer having a glycidyl group in a ratio of at least 1.0% by weight, preferably from 20 to 100% by weight.

A hydrophilic monomer is preferably copolymerized in the hydrophobic polymer together with the hydrophobic monomer. A carboxyl group-containing monomer such as acrylic acid and methacrylic acid, a hydroxyl group-containing monomer such as hydroxylethyl acrylate, an alkylene oxide-containing monomer, an acrylamide, a methacrylamide, a sulfon group-containing monomer, and an amino group-containing monomer are preferably usable as the hydrophilic monomer. The hydroxyl group-containing monomer, carboxyl group-containing monomer, amido group-containing polymer and sulfo group-containing monomer are particularly preferred.

When the hydrophilic monomer is excessively contained, the polymer is become water soluble. Therefore, the content of the hydrophilic monomer is preferably from 0.1 to 30%, more preferably 1.0 to 20%, by weight.

The composite latex useful in the invention can be made to a cross-linked composite latex by selection of kind of the foregoing hydrophobic monomer and/or hydrophilic monomer. For example, a hydrophobic monomer having a cross-linkable group such as a carboxyl group, a glycidyl group, an amino group, an amido group or an N-methylol group, is usable such the purpose.

The composite latex may contains an monomer having at least two polymerizable unsaturated ethylenic groups. As such the monomer, the followings are usable: for example, a monomer having two vinyl groups such as divinylbenzene, ethylene glycol diacrylate, ethylene glycol dimethacrylate, diethylene glycol diacrylate, diethylene glycol dimethacrylate and N,N-methylenebisacrylamide, a monomer having three vinyl groups such as trivinylcyclohexane, trimethylpropane triacrylate, trimethylpropane trimethacrylate and pentaerythritol methacrylate, and a monomer having four vinyl groups such as pentaerythritol tetracrylate and pentaerythritol tetramethacrylate. However the kind of monomer is not limited to the above-mentioned.

The average particle diameter of the composite latex of the invention is preferably from 0.005 $\mu$m to 3.0 $\mu$m, particularly preferably from 0.01 $\mu$m to 0.8 $\mu$m.

The composite latex can be polymerized by, for example, an emulsion polymerization method, a solution polymerization method, a bulk polymerization method, a suspension polymerization method or an irradiation polymerization method. To prepare the composite latex, the polymerization is performed in the presence of inorganic particles. As the inorganic particles, an inorganic substance such as the metal oxides is useful which is described later as the inorganic particle to be added to the hydrophilic colloid layer.

In the case of solution polymerization, the composite polymer is usually obtained by polymerization of a mixture of monomers dissolved in a solvent in a proper concentration, usually, a mixture of monomers of not more than 40% by weight, preferably from 10 to 25% by weight, of the solvent, a temperature of from 10 to 200° C., preferably from 30 to 120° C., for a time of from 0.5 to 48 hours, preferably from 2 to 20 hours, in the presence of an initiator.

As the initiator, an initiator soluble in the solvent may be used, for example, an organic solvent-soluble initiator such as benzoyl peroxide, azobisisobutylonitryl (AIBN) and di-t-butyl peroxide, a water-soluble initiator such as ammonium persulfate (APS), potassium persulfate and 2,2'-azo-bis(2-amidinopropane) hydrochloride, and a redox type initiator composed of a combination of the above-mentioned and a $Fe^{2+}$ salt or sodium hydrogen sulfite are usable.

As the solvent, one capable of dissolving the mixture of monomers may be used, for example water, methanol, ethanol, dimethyl sulfoxide, dimetylformamide, dioxane and a mixed solvent composed of two or more kinds of the forgoing solvents are usable. After the completion of polymerization, the remained non reacted mixture can be removed by pouring the reacted mixture into a medium not capable of dissolving the formed copolymer for precipitating the reaction product, and drying the precipitated product.

In the case of the emulsion polymerization, water is used as the dispersing medium, and from 10 to 50% by weight to water of the monomer, from 0.05 to 5% to the monomer of the initiator, and from 0.1 to 20% by weight to the monomer of a surfactant are used. The polymer can be obtained by polymerization of the monomer or monomers at a temperature of from about 30° C. to 100° C., preferably from 60 to 90° C., for 3 to 8 hours while stirring. The concentration of the monomer, the amount of the initiator, the reaction temperature and the reaction time may be changed widely and easily changed.

As the initiator, a water-soluble peroxide such as potassium peroxide and ammonium peroxide, a water-soluble azo compound such as 2,2'-azo-bis(2-amidinopropane) hydrochloride, and a redox type initiator composed of a combination of the above compound and a reducing agent such as a $Fe^{2+}$ salt and sodium hydrogen sulfite are usable.

A water-soluble high molecular substance is useful as the dispersing agent, and any of an anionic surfactant, a cationic surfactant, a an ampholytic surfactant may be used. The water-soluble high molecular substance includes a synthesized high molecular substance and a natural water-soluble high molecular substance, and both of them are preferably useable in the invention. As the synthesized water-soluble high molecular substance, that having a nonionic group, an anionic group, a cationic group, a nonionic group and an anionic group, a nonionic group and a cationic group, or an anionic group and a cationic group in the molecular structure thereof is usable. Examples of the nonionic group include an ether group, an alkylene oxide group, a hydroxyl group, an amido group and an amino group. Examples of the anionic group include a carboxyl group and a salt thereof, a phosphoric group and a salt thereof, and a sulfonic group and a sat thereof. Examples of the cationic group include a quartenary ammonium base and a tertiary amino group.

In the case of the natural water-soluble high molecular substance, that having a nonionic group, an anionic group, a cationic group, a nonionic group and an anionic group, a nonionic group and a cationic group, or an anionic group and a cationic group in the molecular structure thereof is usable.

In the both of the cases of synthesized polymer and natural high molecular substance, one having an anionic group and one having a nonionic group and an anionic group are preferably used.

As the water-soluble polymer, one having a solubility of not less than 0.05 g, preferably not less than 0.1 g, per 100 g of water at 20° C. As the example of the synthesized water-soluble polymer, one containing a repeating unit represented by the following Formulas (1) and/or (2) is cited.

Formula 1

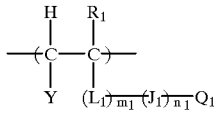

In the formula, $R_1$ is a hydrogen atom, an alkyl group, a halogen atom or a —$CH_2COOM$, and preferably an alkyl group having 1 to 4 carbon atoms. $L_1$ is a di-valent linking group, for example, —CONH—, —COO—, —OCO—, —CO— or —O—. $J_1$ is an alkylene group, an arylene group or an oxyalkylene group. $Q_1$ is

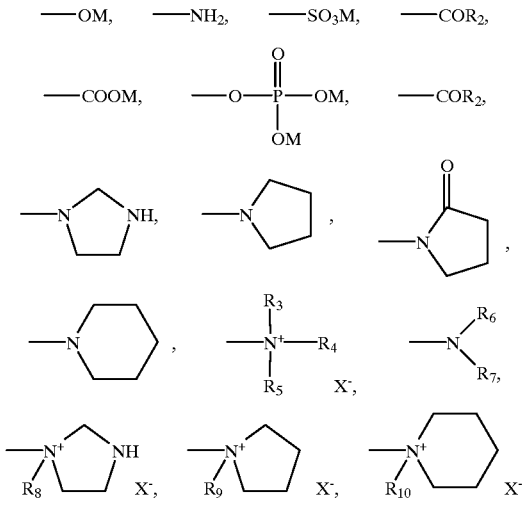

Among them, —COOM and —$SO_3M$ are preferable and —$SO_3M$ is particularly preferred. M is a hydrogen atom or a cation such as an alkali metal ion and an ammonium ion. $R_2$, $R_3$, $R_4$, $R_5$, $R_6$, $R_7$, $R_8$, $R_9$, and $R_{10}$ are each a an alkyl group having 1 to 20 carbon atoms, and $X^-$ is an anion, $m_1$ and $n_1$ are each 0 or 1. Y is a hydrogen atom or

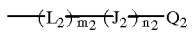

and $L_2$, $J_2$, $Q_2$, $m_2$ and $n_2$ are each a synonym for $L_1$, $J_1$, $Q_1$, $m_1$ and $n_1$, respectively.

Formula 2

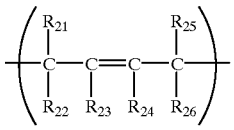

In the formula, $R_{21}$, $R_{22}$, $R_{23}$, $R_{24}$, $R_{25}$ and $R_{26}$ are each a hydrogen atom, an alkyl group having 1 to 8 carbon atoms, an aryl group having 6 to 20 carbon atoms or —$SO_3X$, X is a hydrogen atom, an alkali metal atom, an alkali-earth metal atom, an ammonium group or an amino group, and at least one of $R_{21}$ trough $R_{26}$ is —$SO_3X$.

The synthesized water-soluble polymer having the repeating unit represented by Formulas 1 and 2 may be a homopolymer of the repeating unit represented by Formula 1 or 2, or one containing another component.

As such the other component, an acrylic acid ester, a methacrylic acid ester, a vinyl ester, an olefin, a styrene, a crotonic acid ester, itaconic acid di-ester, maleic acid di-ester, fumalic acid di-ester, an allyl compound, a vinyl ether, a vinyl ketone, a glycidyl ester, an unsaturated nitrile, and a combination of two or more selected therefrom. Among them, the acrylic acid ester, methacrylic acid ester and styrene are preferred. Concrete examples of the synthesized water-soluble polymer represented by Formula 1 or 2 are shown below.

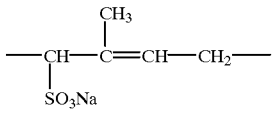

SP-1

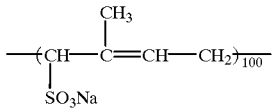

Mw = 20000

SP-2

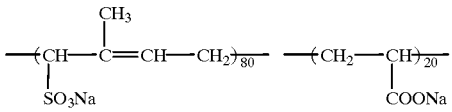

Mw = 30000

SP-3

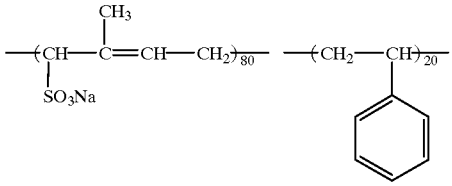

Mw = 40000

SP-4

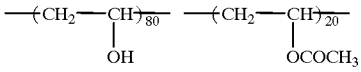

Mw = 40000

SP-5

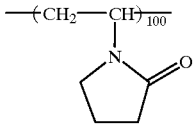

Mw = 9000

SP-6

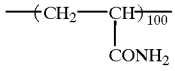

Mw = 20000

SP-7

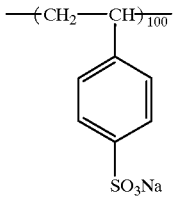

Mw = 10000

-continued

SP-8

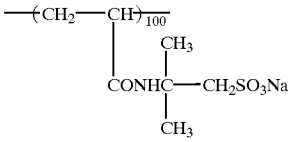

Mw = 20000

SP-9

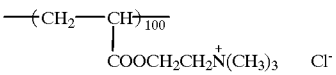

Mw = 10000

SP-10

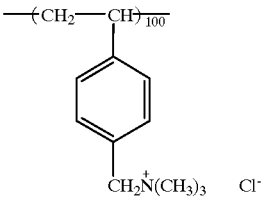

Mw = 150000

SP-11

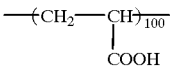

Mw = 40000

SP-12

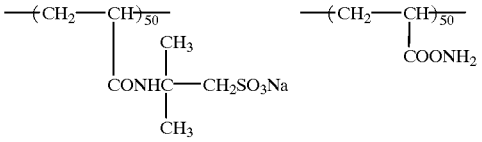

Mw = 40000

SP-13

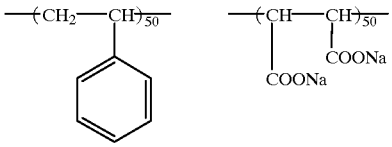

Mw = 5000

-continued

SP-14

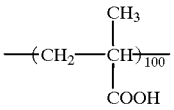

Mw = 20000

As the natural water-soluble polymer, those described in "Comprehensive Technical Data of Water-soluble High Molecular Resin by Dispersion Method", edited by Keiei Kaihatsu Center, are cited, which include lignine, starch, pullulan, cellulose, dextran, dextrin, glycogen, alginic acid, gelatin, collagen, guar gum, gum arabic, laminaran, lichenin, nigeran, and their derivatives. As the derivative, sulfonized, carboxylized, phosphazed, sulfoalkylized, carboxyalkylized, and alkyl-phosphazed one, and their salts are preferred. Glucose, gelatin, dextran, cellulose, pullulan, glucomannan, dextrin, gellan gum, locust bean gum, xanthan gum, and their derivatives are particularly preferred.

A metal alkoxide compound is preferably used for polymerization of the composite latex. The metal alkoxide compounds includes ones so called a coupling agent. Various types of coupling agent, such as a silane coupling agent, a titanium coupling agent, an aluminum coupling agent and zirconium coupling agent, are available on the market. Among them, the silane coupling agent and the titanium coupling agent.

Examples of preferable metal alkoxide compounds are shown below.

ST-1

$Si(OMe)_4$

ST-2

$Ti(OPr)_4$

ST-3

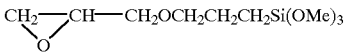

ST-4

$HS—CH_2CH_2CH_2Si(OMe)_3$

ST-5

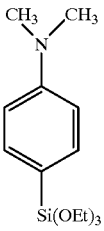

-continued
ST-6
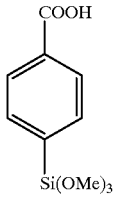
ST-7
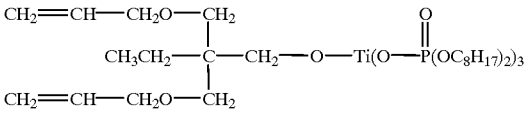
ST-8
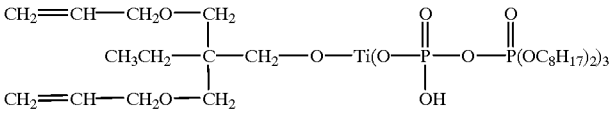
ST-9
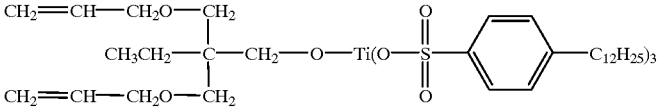
ST-10
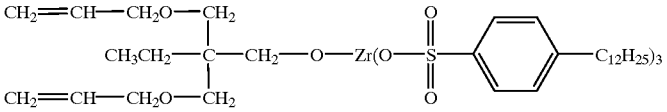
ST-11
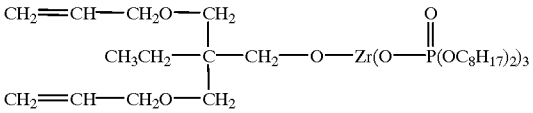
ST-12
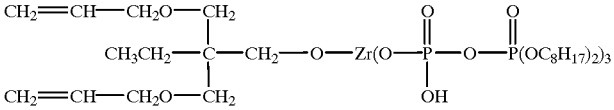
ST-13
$C_{10}H_{21}Si(OCH_3)_3$
ST-14
$CH_3(CH_2)_7Si(OC_2H_5)_3$
ST-15
$CH_2{=}CHSi(OC_2H_4OCH_3)_3$
ST-16
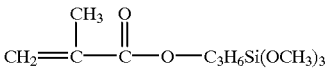
ST-17
$NH_2{-}C_2H_4{-}NHC_3H_6Si(OCH_3)_3$
ST-18
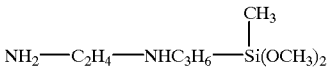
ST-19
$(CH_3O)_3Si{-}C_3H_6{-}NH{-}C_2H_4{-}NHCH_2COOH$
ST-20
$(CH_3O)_3Si{-}C_3H_6{-}NH{-}C_2H_4{-}NH{-}CH_2{-}CH{=}CH_2$ -continued

ST-21

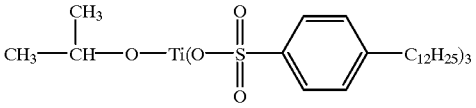

ST-22

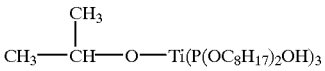

ST-23

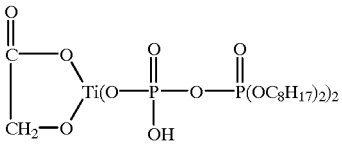

ST-24

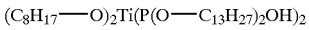

ST-25

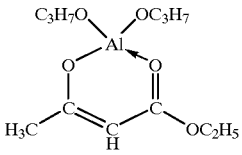

The composite latex may be added to the non-light-sensitive hydrophilic colloid layer in a form of dissolved or dispersed in water. An ultrasonic dispersing device, a ball mill, an attriter, a pearl mill, three roller mill, a high speed grinding apparatus are preferably used for dispersing.

As the inorganic particle to be contained in the composite latex, the inorganic particles later-mentioned as the inorganic particles preferably added to the non-light-sensitive hydrophilic colloid layer are preferably used.

The weight ratio of the inorganic particle and the polymer latex composition in the composite latex is preferably from 100/1 to 1/100. When the composite latex is used, the amount of polymer and that of inorganic particle of the composite latex are each counted as the amount of the polymer composition and that of the inorganic particle composition according to the invention, respectively. The amount of the composite latex is usually from 0.1 to 5.0 g/m$^2$, preferably from 0.2 to 4.0 g/m$^2$.

Concrete examples of the composite latex are shown below. However, the invention is not limited thereto.

| No. | Polymer | Inorganic particle (Weight-% to polymer) | | Metal alkoxide (Weight-% to polymer) | | Dispersant (Weight-% to polymer) |
|---|---|---|---|---|---|---|
| PL-1 | $-(CH_2-C(CH_3)(COOCH_3))_{100}-$ | SO-17 | (100) | — | SF-1 | (10) |
| PL-2 | $-(CH_2-C(CH_3)(COOCH_3))_{80}-(CH_2-C(CH_3)(COOCH_2CH_2OH))_{20}-$ | SO-1 | (100) | — | SF-5 | (5) |
| PL-3 | $-(CH_2-C(CH_3)(COOCH_3))_{80}-(CH_2-C(CH_3)(COOCH_2CH_2OH))_{20}-$ | SO-4 | (123) | — | Hydroxypropyl cellulose | (22.5) |
| PL-4 | $-(CH_2-CH(COOC_2H_5))_{90}-(CH_2-C(CH_3)(COOCH_2CH_2OH))_{10}-$ | SO-1 | (200) | — | SP-4<br>SF-1 | (5)<br>(1) |
| PL-5 | $-(CH_2-CH(COOC_2H_5))_{98}-(CH_2-CH(COOH))_{20}-$ | SO-1 | (200) | — | SP-4<br>SF-1 | (5)<br>(5) |
| PL-6 | $-(CH_2-C(CH_3)(COO-C_6H_{11}))_{80}-(CH_2-C(CH_3)(COO(i)C_9H_{19}))_{20}-$ | SO-1 | (200) | ST-3(5) | SP-4 | (10) |

-continued
| No. | Polymer | Inorganic particle (Weight-% to polymer) | | Metal alkoxide (Weight-% to polymer) | | Dispersant (Weight-% to polymer) |
|---|---|---|---|---|---|---|
| PL-7 | 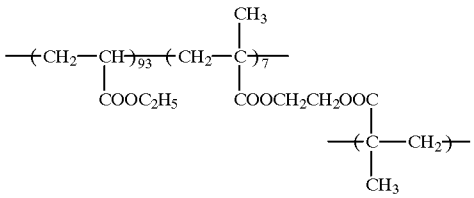 | SO-1 | (300) | ST-16(5) | SP-3 | (10) |
| PL-8 | 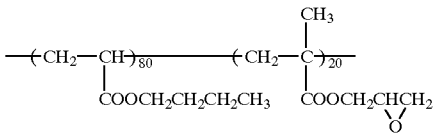 | SO-19 | (100) | — | SP-3 | (10) |
| PL-9 | 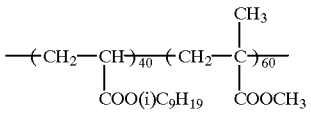 | SO-4 | (200) | — | SP-1 | (10) |
| PL-10 | 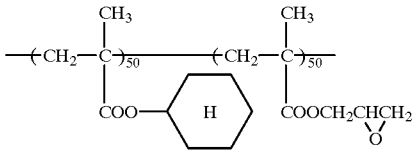 | SO-1 | (500) | — | SP-3 | (10) |
| PL-11 | 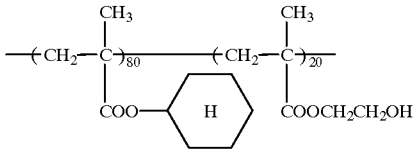 | SO-4 | (200) | ST-16(5) | SP-6 | (10) |

-continued
| No. | Polymer | Inorganic particle (Weight-% to polymer) | | Metal alkoxide (Weight-% to polymer) | | Dispersant (Weight-% to polymer) |
|---|---|---|---|---|---|---|
| PL-12 | 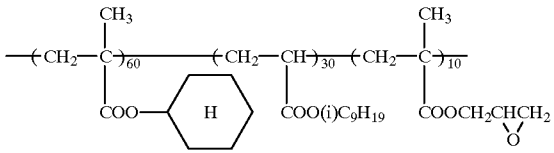 | SO-1 | (200) | ST-16(1) | SP-3 | (10) |
| PL-13 | 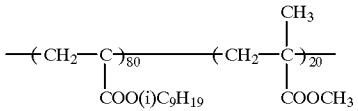 | SO-20 | (100) | — | SF-1 | (10) |

Any of gelatin usually used in a hydrophilic layer of photographic material may be used in the BC layer according to the invention.

Lime-processed gelatin, acid-processed gelatin, a hydrolysis product of gelatin and a enzyme decomposition product of gelatin may be used. Gelatin derivatives are also usable which are obtained by reacting gelatin with various compounds such as an acid halide, an acid anhydride, an isocyanate, bromoacetic acid, an alkanesultone, a vinylsulfonamide, a maleinimide, a polyalkylene oxide and an epoxy compound.

The amounts of polymer latex and gelatin is decided according to the condition of the opposite side or the light-sensitive layer such as the amount of the binder for taking the balance of curling.

According to the invention, the weight ratio of polymer latex to gelatin in the BC layer is from 0.5 to 3.0, preferably from 0.7 to 2.0.

The amount of the polymer latex is preferably from 0.1 to 10.0 g/m$^2$, more preferably from 0.2 to 5.0 g/m$^2$.

The amount of gelatin is preferably from 0.1 to 5.0 g/m$^2$, more preferably from 0.2 to 4.0 g/m$^2$.

It is preferred that the surface of the outermost layer provided on the side of the support, on which the non-light-sensitive hydrophilic colloid layer is coated, has a Smooster value of from 25 to 300 mmHg. The Smooster value is more preferably from 100 to 300 mmHg, particularly preferably from 100 to 200 mmHg.

The Smooster value in the invention is a value indicating a degree of the irregularity of the surface, and a larger Smooster value corresponds to a larger irregularity of the surface. The Smooster value is measured by an ari micrometer type measuring apparatus according to the method described in "Japan TAPPI Test Method for paper and Pulp No. 5-74". In this method, a disc shaped air suction unit having a concentric circle suction groove is contacted to the surface of sample to be measured and the air in the system is sucked by a rotary pump measured. Then the air pressure in mmHg in the suction unit is measured. A higher irregularity of the surface of sample causes a higher air pressure since air is easily enter into the suction unit through the gap between the surface of sample and the suction unit when the irregularity of the sample surface is higher. In the invention, the Smooster value is a value measured by Smooster SM-B6 manufactured by Tooei Densi Kogyo Co., Ltd. The measurement is performed at a temperature of 23° C. and a relative humidity of 48%.

In the light-sensitive material of the invention, an inorganic particle is preferably contained in a non-light-sensitive hydrophilic colloid layer provided on the BC layer side, in concrete in an antihalation layer and/or a protective layer thereof. The inorganic particle is preferably a metal oxide, and a metal compound oxide is also usable. The Smooster value can be principally controlled by the addition of the inorganic particle in the outermost layer. The Smooster value is generally raised when the size of the matting agent is larger and the amount of the inorganic particle is increased. The using amount of the inorganic particle is preferably from 0.1 to 5 g/m$^2$, more preferably from 0.3 to 3.0 g/m$^2$.

Furthermore, in the light-sensitive material of the invention, the inorganic particle may also be contained in one or more silver halide emulsion layers or hydrophilic colloid layers provided on the emulsion coated side. It is preferred that the inorganic particle is contained in the silver halide emulsion layer.

The inorganic particle usable in the invention includes an oxide, nitride and sulfide of metal, and the metal oxide is preferred. As the metal oxide, a particle of a single oxide or compound oxide of the following metals are preferable: Na, K, Ca, Ba, Al, Zn, Fe, Cu, Ti, Sn, In, W, Y, Sb, Mn, Ga, V, Nb, Tu, Ag, Bi, B, Si, Mo, Ce, Cd, Mg, Be and Pb. The particle of the single oxide or compound oxide of Y, Sn, Ti, Al, V, Sb, In, Mn, Ce, B and Si are particularly preferable from the viewpoint of mixing ability with the emulsion.

Such the metal oxide is preferably used even when the oxide is crystallized or amorphous, and an amorphous metal oxide is particularly preferred. The average diameter of the metal oxide is preferably from 0.5 to 3,000 nm, more preferably from 3 to 500 nm. Such the metal oxide is preferably dispersed in water and/or water-miscible solvent. The concrete examples of the metal oxide are shown below.

| | |
|---|---|
| SO-1 | $SiO_2$ |
| SO-2 | $TiO_2$ |
| SO-3 | ZnO |
| SO-4 | $SnO_2$ |
| SO-5 | MgO |
| SO-6 | $MnO_2$ |
| SO-7 | $Fe_2O_3$ |
| SO-8 | $ZnSiO_4$ |
| SO-9 | $Al_2O_3$ |
| SO-10 | $BeSiO_4$ |
| SO-11 | $Al_2SiO_5$ |
| SO-12 | $ZrSiO_4$ |
| SO-13 | $CaWO_4$ |
| SO-14 | $CaSiO_3$ |
| SO-15 | $InO_2$ |
| SO-16 | $SnSbO_2$ |
| SO-17 | $Sb_2O_5$ |
| SO-18 | $Nb_2O_5$ |
| SO-19 | $Y_2O_3$ |
| SO-20 | $CeO_2$ |
| SO-21 | $Sb_sO_3$ |

Colloidal silica is most preferred among the foregoing metal oxides. The using amount of the colloidal silica is preferably from 0.1 to 5.0 g/m$^2$, more preferably from 0.3 to 3.0 g/m$^2$. The above-mentioned inorganic particles are also useful as the inorganic particles to be contained in the foregoing composite latex.

The silver halide composition of the silver halide photographic light-sensitive material of the invention is preferably pure silver chloride, silver chlorobromide having a silver chloride content of not less than 60 mole-%, and silver chloroiodobromide having a silver chloride content of not less than 60 mole-% are preferred.

The average grain diameter of the silver halide grains is preferably not more than 0.7 $\mu$m, particularly preferably from 0.1 to 0.5 $\mu$m. The "average grain diameter" is a term usually used and easily under stood by skilled one in the field of the photographic science. The "grain diameter" means the diameter of a grain when the grain has a shape of sphere or a shape capable of approximating to a sphere. When the grain is a cube, the diameter is defined by the diameter of a sphere converted from the cube. Regarding the detail of the method for measuring the average diameter, C. E. Mees & T. H. James, "The Theory of the Photographic Process" Third version, p.p. 36–43, 1966, Macmillan, can be referred.

Silver halide grains having any shape such as tabular, spherical, cubic, tetradecahedral, and regular octahedral, may be used without any limitation. A narrow grain diameter distribution is preferred, and a monodisperse emulsion is preferred in which 90%, preferably 95%, of the whole grain number has a diameter within the range of ±40% of the average diameter.

Any procedure such as a single jet method, a double jet method and a combination thereof may be applied to the procedure for reacting a soluble silver salt and a soluble halide salt.

A method so called reverse mixing method in which silver halide grains are formed in the presence of excessive silver ion may also be applied. An embodiment of the double-jet mixing so called a controlled double-jet mixing method can be applied, in which the pAg of the liquid phase, in which silver halide grains are formed, is maintained at a constant value. A silver halide emulsion composed of grains having a regular crystal shape and a uniform grain diameter can easily be obtained by such the method.

It is preferred that a complex salt containing an element of Groups III to XIII of the periodic table such as cadmium, zinc, lead, thallium, iridium, rhodium, ruthenium, osmium, iron, copper, platinum and palladium, is added to the silver halide grain of the emulsion at least one of the step of grain formation and grain growing. As the ligand of the complexes, a halogen atom, a nitrosyl group, a cyano group, an aquo group, an alkyl group, a pseudo-halogen group, an alkoxyl group, an ammonium group and an optional combination thereof may be used.

The surface of silver halide grain can be controlled by using a water-soluble halide salt or a fine grain of silver halide. Such the method has been known in the field of the art as a conversion method.

The silver halide grain may be composed of an uniform composition from interior to the surface thereof, or composed of a plurality of layers each different in the silver halide composition, the kind and the amount of the doping agent and the distribution of crystal lattice defects.

In the invention, plural kinds of silver halide grains may be used in combination, which are different from each other in the diameter, sensitivity, crystal habit, spectral sensitivity, halide composition, kind and amount of doping agent, producing condition such as silver electrode potential, pH value and desalting condition, surface condition, chemical sensitized condition. In such the case, the silver halide grains different from each other may be contained in the same layer or in different plural layers.

Regarding the silver halide emulsion and the producing method therefore, Research Disclosure (RD) 17643, p.p. 22 to 23 (December 1978) and publications cited therein describe in detail.

In the light-sensitive material usable in the invention, various compounds may be contained for the purpose of inhibition of fogging and stabilization of the photographic property in the course of producing process, storage and processing of the light-sensitive material. The following compounds which are known as an antifoggant or a stabilizer: for example, an azole such as a benzothiazolium salt, a nitroindazole, a nitrobenzimidazole, a chlorobenzimidazole, a bromobenzimidazole, a mercaptothiazole, a mercaptobenzothiazole, a mercaptobenzimidazole, a mercaptothiadiazole, an aminotriazole, a benzotriazole, a nitrobenzotriazole and a mercaptotriazole particularly 1-phenyl-5-mercaptotetrazole; a mercaptopyrimidine, a mercaptotriazine, a thioketo compound such as an oxazolinethione; an azaindene such as a triazaindene, a tetrazaindene particularly a 4-hydroxy substituted 1,3,3a,7-tetrazaindene and a pentazaindene; benzenethiosulfonic acid, benzenesulfinic acid, benzenesulfonamide and potassium bromide. A substituted or unsubstituted heterocyclic or condensed heterocyclic ring containing one of N, O, S and Se, and a water-soluble halide are particularly preferred.

The photographic emulsion layer and the non-light-sensitive hydrophilic colloid layer of light-sensitive material of the invention may contain an inorganic or organic hardener. For example, the following compounds may be used singly or in combination: a chromium salt such as chromium alum and chromium acetate, an aldehyde such as formaldehyde, glyoxal and glutaraldehyde, a N-methylol compound such as dimethylolurea, and methyloldimetyl-hidantoine, a dioxane derivative such as 2,3-dihydroxydioxane, a reactive vinyl compound such as 1,3,5-triacryloyl-hexahydro-s-triazine, bis(vinylsulfonyl)methyl ether, and N, N-methylene-bis[β-(vinylsulfonyl)propionamide), a reactive halogen compound such as 2,4-dichloro-6-hydroxy-s-triazine, a mucohalogenic acid such as mucochloric acid and phenoxymucochloric acid, an isoxazole, dialdehyde starch, gelatin reacted with 2-chloro-6-hydroxytriazine, an isocyanate and a carboxyl group reactive type hardener.

In the light-sensitive emulsion layer and/or non-light-sensitive hydrophilic colloid layer of the light-sensitive material according to the invention, various kinds of know surfactant may be added for the purpose of coating aid, anti-static, improvement of the slidability, dispersion of the additive, prevention of adhesion and improvement of the photographic property.

Various kinds of additive such as a desensitizer, a plasticizer, a lubricant, a development accelerator, an oil and a colloidal silica, may be further used in the light-sensitive material of the invention.

As the foregoing additives, those described in the foregoing RD17643, p.p. 22 to 31 are concretely usable.

The following compounds may be used in a photographic constituting layer of the light-sensitive material when the silver halide photographic light-sensitive material is applied as the light-sensitive material for graphic arts.

(1) Solid particle dispersion of dye

Compounds described in JP O.P.I. No. 7-5629, page (3), [0017] to page (16), [0042]

(2) Compound having a acid group

Compounds described in JP O.P.I. No. 62-237445, page 292(8), lower left column, line 11 to page 309(25), lower right column, line 3.

(3) Acidic polymer

Compounds described in JP O.P.I. No. 6-186659, page (10), [0036] to page (17), [0062]

(4) Sensitizing dye (dyes each having the maximum spectral sensitivity within the region of from 600 nm to 900 nm in the followings)

Compounds described in JP O.P.I. No. 5-224330, page (3), [0017] to page (13), [0040]

Compounds described in JP O.P.I. No. 6-194771, page (11), [0042] to page (22), [0094]

Compounds described in JP O.P.I. No. 6-242533, page (2), [0015] to page (8), [0034]

Compounds described in JP O.P.I. No. 6-337492, page (3), [0012] to page (34), [0056]

Compounds described in JP O.P.I. No. 6-337494, page (4), [0013] to page (14), [0039]

(5) Super sensitizer

Compounds described in JP O.P.I. No. 6-347938, page (3), [0011] to page (16), [0066]

(6) Tetrazolium compound

Compounds described in JP O.P.I. No. 6-208188, page (8), [0059] to page (10), [0067]

(7) Pylidinium compound

Compounds described in JP O.P.I. No. 7-110556, page (5), [0028] to page (29), [0068]

(8) Redox compound

Compounds described in JP O.P.I. No. 4-245243, page 235(7), to page 250(22)

A film of a synthesized polymer, which may contains a colorant, such as cellulose acetate, cellulose acetate lactate, polystyrene, polyethylene terephthalate and polyethylene naphthalate is useful in the light-sensitive material of the invention. The support may have a magnetic recording layer, an antistatic layer or a peeling layer.

Developing agents usable in the processing of the light-sensitive material of the invention include a dihydroxybenzene such as hydroquinone, chlorohydroquinone, bromohydroquinone, 2,3-dichlorohydroquinone, methylhydroquinone, isopropyl-hydroquinone and 2,5-dimethylhydroquinone, a 3-pyrazolidone such as 1-phenyl-3-pyrazolidone, 1-phenyl-4-methyl-3-pyrazolidone, 1-phenyl-4,4-dimethyl-3-pyrazolidone, 1-phenyl-4-ethyl-3-pyrazolidone and 1-phenyl-5-methyl-3-pyrazolidone, an aminophenol such as o-aminophenol, p-aminophenol, N-methyl-o-aminophenol, N-methyl-p-aminophenol and 2,4-diaminophenol, pyrogalol, ascorbic acid, a 1-aryl-3-pyrazoline such as 1-(p-hydroxyphenyl)-3-aminopyrazoline, 1-(p-methylaminophenyl)-3-aminopyrazoline, 1-(p-aminophenyl-3-aminopyrazoline and 1-(p-amino-N-methylphenyl)-3-aminopyrazoline, a transition metal complex such as a complex of a transition metal such as Ti, V, Cr, Mn, Fe, Co, Ni and Cu in a form having a reducing ability for development, for example, a complex $Ti^{3+}$, $V^{2+}$, $Cr^{2+}$ or $Fe^{2+}$ the ligand of which may be an aminopolycarboxylic acid such as ethylenediamine- tetraacetic acid (EDTA), and diethylenetriaminepentaacetic acid (DTPA) and their salts, a phosphoric acid such as hexametapolyphosphoric acid, tetrapolyphosphoric acid and their salts, which may be used singly or in combination. Combinations of a 3-pyrazolidone and a dihydroxybenzene, an aminophenol and a dihydroxybenzene, 3-pyrazolidone and ascorbic acid, an aminophenol and ascorbic acid, a 3-pyrazolidone and a transition metal complex, and an aminophenol and a transition metal complex, are preferably used. The developing agent is usually used in an amount of from 0.01 to 1.4 moles/liter.

In the invention, compounds described in Japanese Examined Patent Publication, hereinafter referred to Japanese Patent, No. 62-4702, JP O.P.I. Nos. 3-51844, 4-26838, 4-362942, 1-319031 and 7-13303 are usable as a silver sludge preventing agent.

The effluent of a developing solution can be regenerated by an electric current. In concrete, a cathode, for example, an electric conductor such as stainless steel wool or a semiconductor, is immersed in the effluent of the developer and an anode, for example, an insoluble electric conductor such as carbon, gold, platinum and titanium, is immersed in a solution of an electrolyte and the effluent and the solution of electrolyte are set so that the liquids are contacted through an ion-exchange membrane. Then an electric current is applied through the electrodes to regenerate the effluent. At the regeneration, various kinds of additives such as a preservant, an alkaline agent, a pH buffering agent, a sensitizing agent, an antifoggant or a silver sludge preventing agent may be replenished. Moreover, the electric current may be applied while processing the light-sensitive material. The additives may also be replenished in such the case. In the case of developing solution is recycled by the regeneration, the transition metal complexes are preferably used as the developing agent.

A sulfite and metabisulfite to be used as the preservant of the developing solution include sodium sulfite, potassium sulfite, ammonium sulfite and sodium metabisulfite. The amount of the sulfite is preferably not less than 0.25 moles/liter, particularly preferably from not less than 0.4 moles/liter.

The following additives may be added to the developing solution according to necessity: an alkaline agent such as sodium hydroxide and potassium hydroxide, a pH buffering agent such as a carbonate, a phosphate, a borate, boric acid, acetic acid, citric acid and an alkanolamine, a dissolving aid such as a polyethylene glycol and its eater, and an alkanolamine, a sensitizing agent such as a nonionic surfactant including a polyoxyethylene and a quaternary ammonium compound, a surfactant, a defoaming agent, an antifoggant, for example, a halide salt such as potassium bromide and sodium bromide, nitrobenzindazole, nitrobenzimidazole, benzotriazole, benzothiazole, a tetrazole and a thiazole, a chelating agent such as ethylenediaminetetraacetic acid and its alkaline salt, a nitrylotriacetate and a polyphosphate, a development accelerator such as compounds described in U.S. Pat. No. 2,304,025 and Japanese Patent No. 47-45541, a hardener such as glutaraldehyde and its adduct with a bisulfite, and a defoaming agent.

A fixing solution having an usual composition is usable. A thiosulfate such as sodium thiosulfate, potassium thiosulfate and ammonium thiosulfate, a thiocyanate such as sodium thiocyanate, potassium thiocyanate and ammonium thiocyanate, and an organic sulfur compound capable of forming a water-soluble stable silver complex known as a fixing agent, may be used as a fixing agent. The fixing solution may contains a water-soluble aluminum salt, such as aluminum chloride and aluminum sulfate and potassium alum, which is effective as a hardener. The fixing solution may further optionally contains a preservant such as a sulfite and bisulfite, a pH buffering agent such as acetic acid, a pH controlling agent such as sulfuric acid, and a chelating agent having a water softening ability, according to necessity.

In the processing, a washing treatment is applied after the fixing. The washing treatment may be performed by a method in which several liters per minutes of water is newly supplied corresponding to the processing, a method in which water is recycled by circulation or regeneration by a treatment using a chemical, a filter, ozone or light, or a method in which a solution containing a stabilizing agent is used in place of water for washing and a little amount of the stabilizing solution is supplied corresponding to the processed amount of light-sensitive material.

The mother solutions of developing solution, fixing solution, stabilizing solution and their replenisher are usually supplied in a form of using solution or a solution prepared just before the use by dilution of a concentrated solution. The mother solution or the replenishing solution may be stocked in a form of concentrated solution, a paste of viscous solution, or a single solid component or a mixture solids components which are dissolved at the using time. When the mixture or solid components is used, a method which the components are packed and vacuum-sealed so that the components are separately piled in a layered form and the layers of the components hardly reacted with each other are adjoined, and the package is opened and the contents thereof are dissolved just before the use, or a method in which the components are formed in a tablet, is usable. The method of supplying the tableted composition a dissolving tank or a processing tank is particularly preferred since such the method is excellent in the easy operation, space saving and stability of the processing.

The developing temperature may be set within the ordinary range of from 20 to 50° C. The silver halide photographic light-sensitive material of the invention is preferably processed by an automatic processor. At such the processing, a prescribed amounts of developing solution and fixing solution are supplied in proportion to the processed area of the light-sensitive material. The amount of the replenishing amounts of the developing solution and the fixing solution are each preferably not more than 300 ml per square meter, more preferably from 75 to 200 ml per square meter, for reducing the effluents.

In the processing by the automatic processor, the whole processing period from the moment of insertion of the front edge of the light-sensitive material into the automatic processor to the moment of output the front edge of the light-sensitive material form the drying zone of the processor, dry to dry, is preferably from 10 to 60 seconds.

In the invention, the pH of the developing solution is adjusted within the range of from 9.5 to 11.0, preferably from 9.6 to 10.9. A high contrast image having a gamma value of from 10 to 30 can be obtained by developing within such the range of the pH value.

EXAMPLES

Example 1

Preparation of silver halide emulsion A1

Core grains of silver chlorobromide were prepared by a double-jet method, which were composed of 70 mole-% of silver chloride and silver bromide, and have an average diameter of 0.09 $\mu$m. The core grains were prepared by mixing an aqueous solution of silver nitrate and an aqueous solution of water-soluble halide salts by a double-jet method at 40° C. in the presence of $7\times10^{-8}$ moles of $K_3Rh(NO)_4(H_2O)_2$ and $8\times10^{-6}$ moles of $K_3OsCl_6$ per mole of silver at the time of completion of formation of the grains while maintaining the pH and the silver electrode potential $E_{Ag}$ at 3.0 and 165 mV, respectively. The $E_{Ag}$ was lowered to 125 mV by sodium chloride, and a shell was formed on each of the core grains by a double-jet method. When the shell was formed, $3\times10^{-7}$ moles per mole of silver of $K_2IrCl_6$ and $9\times10^{-8}$ moles per mole of silver of $K_3RhCl_6$ per mole of silver were added to the halide solution. Then the grains were subjected to conversion treatment by the use of silver iodide fine grains.

Thus obtained emulsion was a core/shell type monodisperse cubic silver chloroiodobromide emulsion composed of 70 mole-% of silver chloride, 0.2 mole-% of silver iodide and remainder of silver bromide which have an average diameter of 0.14 $\mu$m and a variation coefficient of 10%.

The emulsion was desalted using a modified gelatin described in JP O.P.I. No. 2-280139, a gelatin in which the amino group thereof was substituted by phenylcarbamyl group, for example compound G-8 in JP O.P.I. No. 2-280139. The $E_{Ag}$ of the emulsion after desalting was 190 mV at 50° C.

To thus obtained emulsion, $8.5\times10^{-4}$ moles per mole of silver of potassium bromide and citric acid to adjust the pH and the $E_{Ag}$ to 5.6 and 123 mV, respectively, and $1\times10^{-3}$ moles of sodium p-toluenesulfonylamide trihydrate (Chloramine T), was added to react. Then the emulsion was chemically sensitized at 55° C. until the maximum sensitivity was obtained after addition of a dispersion of solid particles of elemental sulfur $S_8$ and $1.5\times10^{-5}$ moles of chloroauric acid. The dispersion of the elemental sulfur was prepared by mixing a 0.01% solution of elemental sulfur with the same volume of water and standing for 10 minutes to precipitate the sulfur particles which have an average particle diameter was 300 nm. After that, the emulsion was cooled by 40° C. and $2\times10^{-3}$ moles per mole of silver of 4-hydroxy-6-methyl-1,3,3a,7-tetrazaindene, 3 x 10-4 moles per mole of silver of 1-phenyl-5-mercaptotetrazole and $5\times10^{-3}$ moles per mole of silver of potassium iodide were added to the emulsion. After adjusting the pH of the emulsion to 5.1 using citric acid, 100 mg of sensitizing dye d-1 was added.

Preparation silver halide emulsion A2

Silver halide emulsion A2 was prepared in the same manner as in silver halide emulsion Al except that the amount of $K_3RhCl_6$ was changed to $6\times10^{-8}$ moles. Emulsion A2 showed a sensitivity higher by 40% than that of Emulsion A1 when Emulsion A2 was chemically sensitized in the same manner as in Emulsion A1.

Preparation of a silver halide photographic light-sensitive material to be used for a scanner for graphic arts On a transparent polyethylene terephthalate support having a thickness of 100 $\mu$m, which has been subjected to an anti-static treatment described in JP O.P.I. No. 5-241264, a gelatin subbing layer according to the following receipt 1 was coated so that the amount of gelatin was 0.55 g/m$^2$. On the gelatin subbing layer, silver halide emulsion layer 1 according to the following receipt 2 was coated so that the coating amounts of silver and gelatin were each 1.73 g/m$^2$ and 0.68 g/m$^2$, respectively, and silver halide emulsion layer 2 according to the following receipt 3 was coated on the emulsion layer 1 so that the coating amounts of silver and gelatin were each 1.73 g/m$^2$ and 0.66 g/m$^2$, respectively. Then a protective layer coating solution according to the following receipt 4 was further coated on the emulsion layer 3 so that the amount of gelatin was 1.3 g/m$^2$. The foregoing layers were coated simultaneously.

On the subbing layer on the opposite side of the support, a backing layer according to the following receipt 5 was coated so that the amount of gelatin was 2.3 g/m$^2$, and a backing protective layer according to receipt 6 was coated on the backing layer so that the amount of gelatin was 0.7 g/m$^2$. The layers of the emulsion side were simultaneously coated by a curtain coating method at a speed of 200 m/minute and set by cooling, then the layers of the backing side were simultaneously coated and set at −1° C. The layers coated on both sides of the support were dried at the same time. Thus a sample of light-sensitive material was obtained which was referred to Sample 1.

Receipt 1 (Gelatin subbing layer)

| | |
|---|---|
| Gelatin | 0.55 g/m$^2$ |
| Saponin | 56.5 mg/m$^2$ |
| Solid particle dispersion of Dye AD-8 | 10 mg/m$^2$ |
| Sodium polystyrenesulfonate (Average molecular weight: 500,000) | 10 mg/m$^2$ |
| Germicide z | 0.5 mg/m$^2$ |

Receipt 2 (Composition of silver halide emulsion layer 1)

| | |
|---|---|
| Silver halide emulsion A1 | 1.73 g/m$^2$ in terms of silver |
| Hydrazine compound H-15 | $2\times10^{-3}$ moles/mole of Ag |
| Compound a | 100 mg/m$^2$ |
| 2-pyridinol | 1 mg/m$^2$ |
| Polymer latex L1 (Particle diameter: 0.25 mm) | 0.25 g/m$^2$ |
| Saponin | 20 mg/m$^2$ |
| 2-mercapto-6-hydroxyprin | 2 mg/m$^2$ |
| 2-mercaptopyrimidine | 1 mg/m$^2$ |

-continued

| | |
|---|---|
| n-propyl gallate | 25 mg/m$^2$ |
| Ascorbic acid | 20 mg/m$^2$ |
| EDTA | 25 mg/m$^2$ |
| Sodium polystyrene sulfate | 15 mg/m$^2$ |

The pH of the coating solution was 5.2

Receipt 3 (Composition of silver halide emulsion layer 2)

| | |
|---|---|
| Silver halide emulsion A2 | 1.73 g/m$^2$ in terms of silver |
| Hydrazine compound H-15 | $4 \times 10^{-3}$ moles/mole of Ag |
| Amino compound AM-1 | 7 mg/m$^2$ |
| 4-hydroxy-6-methyl-1,3,3a, 7-tetrazaindene | $4 \times 10^{-3}$ moles/mole of Ag |
| Saponin | 20 mg/m$^2$ |
| 2-mercapto-6-hydroxyprin | 1 mg/m$^2$ |
| Nicotine acid amide | 1 mg/m$^2$ |
| n-propyl gallate | 25 mg/m$^2$ |
| Mercaptopyrimidine | 1 mg/m$^2$ |
| EDTA | 50 mg/m$^2$ |
| Dye f5 | 15 mg/m$^2$ |
| Polymer latex L2 (Lx-3, composition (9) described in Example 3 of JP O.P.I. No. 5-66512) | 0.5 g/m$^2$ |
| Inorganic particle (Colloidal silica, average particle diameter: 0.05 $\mu$m) | 0.2 g/m$^2$ |
| Dextrin compound (Towa Kasei, PO-20) | 0.3 g/m$^2$ |

Gelatin was a phthalated gelatin, and the pH of the coating solution was 4.8.

Receipt 4 (Emulsion protective layer)

| | |
|---|---|
| Gelatin | 1.3 g/m$^2$ |
| Amino compound | 14 mg/m$^2$ |
| Matting agent: spherical polymethyl methacrylate, average particle diameter: 3.5 $\mu$m | 25 mg/m$^2$ |
| Irregular-shaped silica, average particle size: 8 $\mu$m | 12.5 mg/m$^2$ |
| Surfactant S1 | 20 mg/m$^2$ |
| Lubricant W1 | 75 mg/m$^2$ |
| Redox compound R1 | 30 mg/m$^2$ |
| Compound a | 50 mg/m$^2$ |
| Polymer latex L3 (Average particle size: 0.1 $\mu$m) | 0.25 g/m$^2$ |
| Colloidal silica (Average particle size: 0.05 $\mu$m) | 0.4 g/m$^2$ |
| Hardener h2 | 80 mg/m$^2$ |
| Hardener: 1,3-vinylsulfonyl-2-propanol | 40 mg/m$^2$ |
| Sodium polystyrenesulfonate | 10 mg/m$^2$ |
| Germicide z | 0.5 mg/m$^2$ |

The redox compound was used in a form of dispersion prepared by the following method.

(Dispersion method of redox compound)

| | |
|---|---|
| Redox compound R1 | 2 g |
| Ethyl acetate | 80 g |

The redox compound was dissolved as above-mentioned and mixed with the following gelatin solution.

Surfactant TK-AX, 10% aqueous solution,

| | |
|---|---|
| Surfactant TK-AX, 10% aqueous solution, (Takemoto Yusi Co., Ltd.) | 6 g |
| Gelatin, 15% aqueous solution | 180 g |

The mixture was dispersed by a homogenizer after a preliminary dispersion for 5 minutes. Then ethyl acetate was removed by reducing pressure by 130 mmHg, and dispersion was made up to 280 g by water.

Receipt 5 (Composition of backing layer)

| | |
|---|---|
| Gelatin | 2.0 g/m$^2$ |
| Sodium iso-amyl-n-decylsulfosuccinate | 5 mg/m$^2$ |
| Polymer latex | An amount described in Table 1 |
| Inorganic particle (Colloidal silica, average particle size: 0.05 $\mu$m) | An amount described in Table 1 |
| Sodium polystyrenesulfonate | 10 mg/m$^2$ |
| Dye f1 | 65 mg/m$^2$ |
| Dye f2 | 15 mg/m$^2$ |
| Dye f3 | 100 mg/m$^2$ |
| 1-phenyl-5-mercaptotetrazole | 10 mg/m$^2$ |
| Hardener h3 | 100 mg/m$^2$ |
| Compound D | 10 mg/m$^2$ |
| EDTA | 50 mg/m$^2$ |

Receipt 6 (Backing protective layer)

| | |
|---|---|
| Gelatin | 1.5 g/m$^2$ |
| Matting agent: Monodisperse polymethyl methacrylate, average particle diameter: 5 $\mu$m | 50 mg/m$^2$ |
| Sodium (2-ethylhexyl) sulfosuccinate | 10 mg/m$^2$ |
| Surfactant | An amount described in Table 1 |
| Dye f1 | 65 mg/m$^2$ |
| Dye f2 | 15 mg/m$^2$ |
| Dye f3 | 100 mg/m$^2$ |
| Dye SF-2 (Solid particle dispersion) | 20 mg/m$^2$ |
| Compound a | 50 mg/m$^2$ |
| Hardener h2 | 20 mg/m$^2$ |
| Sodium polystyrenesulfonate | 10 mg/m$^2$ |

Dye SF2 was dissolved in an alkaline solution and citric acid in an amount of 1.2 times of acid group in the dye to precipitate the dye in acidic liquid. The other dyes (including those used in Example 2 and after) were each dispersed by using ZrO beads to a powder having an average particle diameter of 0.1 $\mu$m.

Germicide Z
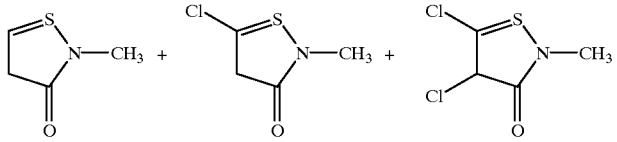
Compound a
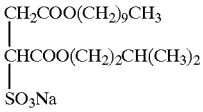
Polymer latex L1
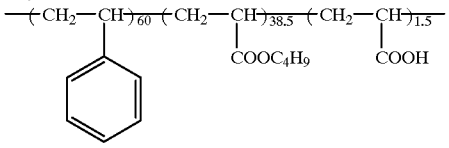
Redox compound R1
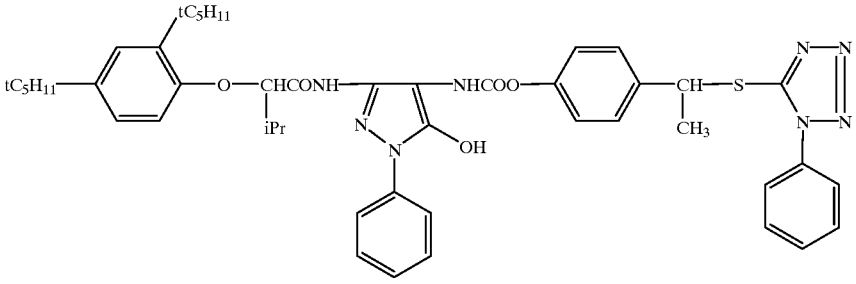
Amino compound AM-1
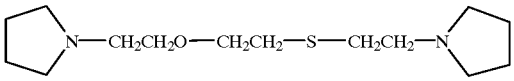
Sensitizing dye d-1
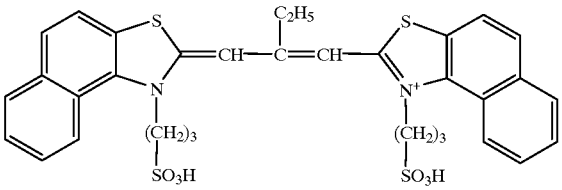
Hardener
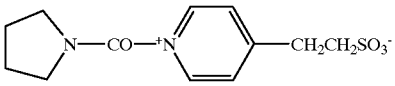
Surfactant
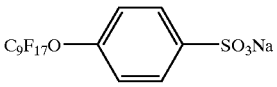
SF-2
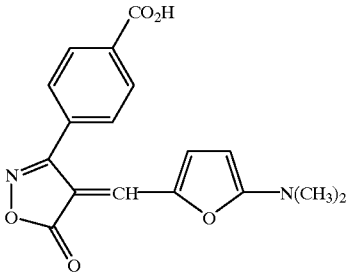

-continued
AD-8
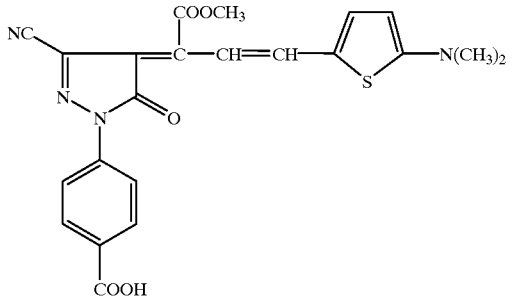
H-15
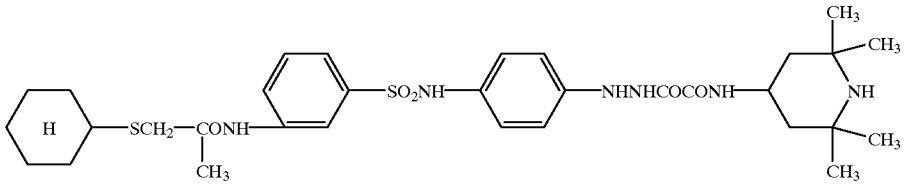
Dye f1
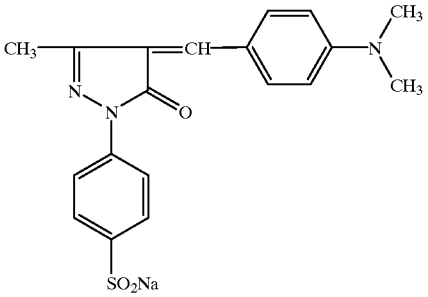
Dye f2
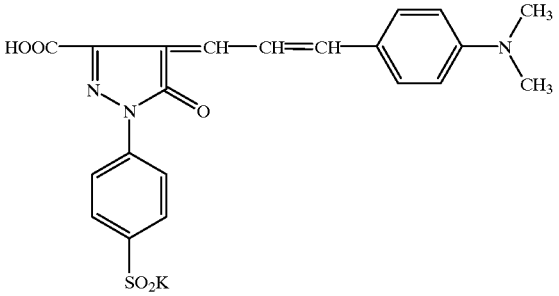
Dye f3
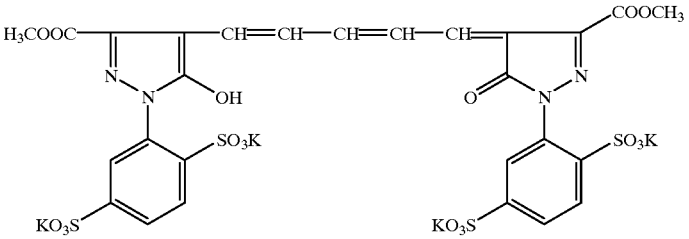
Hardener h3
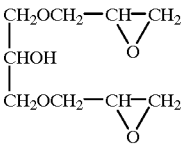

-continued

Polymer latex L3

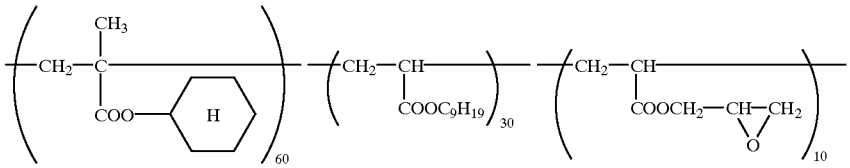

Lubricant W1

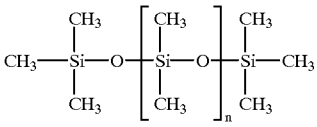

Polymer latex L2

Type Lx-3 composition (9) described in Example 3 of JP O.P.I. No. 5-66512, which is prepared by polymerization of 5.0 parts by weight Of ethyl acrylate, 1.4 parts by weight of methyl methacrylate, 3.0 parts by weight of styrene, and 0.6 parts by weight of sodium acrylamido-2-methylpropenesulfonate, in the presence of 1.25 parts by weight of gelatin.

Compound D

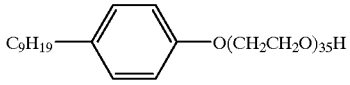

Dye f5

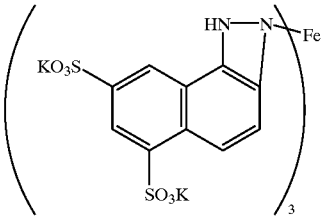

(Composition of developing solution, per liter)

| | |
|---|---|
| Pentasodium dietylenetriaminepentaacetate | 1 g |
| Sodium sulfite | 42.5 g |
| Potassium sulfite | 17.5 g |
| Potassium carbonate | 55 g |
| Erythorbic acid | 5 g |
| Hydroquinone | 20 g |
| 1-phenyl-4-methyl-4-hydroxymethyl-3-pyrazolidone | 0.85 g |
| Potassium bromide | 4 g |
| 5-methylbenzotriazole | 0.2 g |
| Boric acid | 8 g |
| Diethylene glycol | 40 g |
| 8-mercaptoadenine | 0.3 g |
| KOH was added so that the pH was 10.4. | |
| (Composition of fixing solution, per liter) | |
| Ammonium thiosulfate (70% aqueous solution) | 200 ml |
| Sodium sulfite | 22 g |
| Boric acid | 9.8 g |
| Sodium acetate trihydrate | 34 g |
| Acetic acid (90% aqueous solution) | 14.5 g |
| Tartaric acid | 3.0 g |
| Aluininum sulfate (27% aqueous solution) | 25 ml |

The pH of the solution was controlled to 4.9 by sulfuric acid.

Processing condition

The sample was processed by an automatic processor GR-960, manufactured by Konica Corporation, under the following condition.

| (Process) | (Temperature) | (Time) |
|---|---|---|
| Development | 35° C. | 30 seconds |
| Fixation | 35° C. | 20 seconds |
| Washing | Ordinary temperature | 20 seconds |
| Squeezing and drying | 50° C. | 30 seconds |
| Total | | 100 seconds |

(Evaluation of the dimension variation)

An image setter having an exposing drum was used in the evaluation. The sample was fixed on the surface of the exposing drum by a vacuum and stood for 20 minutes, then images of two parallel lines at a distance of 60 cm were exposed to the sample. On the other hand, the sample was exposed in the same manner as in the above-mentioned except that the standing time was changed to 4 minutes. The exposed samples were processed. The processed samples were placed on a light table after output from the processor, and variation of the distance of the image of lines formed on each of the samples was measured by a magnifier with measuring scale having a magnitude of 100. It is required that the variation of the distance is not more than 50 μm. When the variation is 20 μm or less, no problem is raised in the practical use. When the variation is 100 μm or more, such the sample is not acceptable for practical use.

Evaluation of the repeatability of the dimension

The evaluation was carried out in the same manner as in the above-mentioned except that further 4 sheets of the sample were exposed at an interval of 4 minutes. The difference of the sample most shrunken and the sample become longest was measured. It is required that the difference of the distance is not more than 50 μm. When the difference is 20 μm or less, no problem is raised in the practical use. When the difference is 100 μm or more, such the sample is not acceptable for practical use. Thus obtained results are shown in Table 1. Moreover, Samples 2 through 18 were prepared and evaluated in the same manner as in Sample 1 except that the kind and amount of latex and the amount of the inorganic particle were changed as shown in Table 1.

TABLE 1

| No. | BC layer Latex (LX) Kind | BC layer Latex (LX) (g/m²) | BC layer Gelatin (g/m²) | Lx/Gel ratio | Inorganic particle (g/m²) | Smooster value (mmHg) | Variation of dimension (μm) | Repeatability (μm) | Remarks |
|---|---|---|---|---|---|---|---|---|---|
| 1 | LA-1 | 0.50 | 2.5 | 0.2 | 0 | 50 | +100 | 50 | Comp. |
| 2 | LA-1 | 0.75 | 2.5 | 0.3 | 0 | 50 | +75 | 60 | Comp. |
| 3 | LA-1 | 1.25 | 2.5 | 0.5 | 0 | 50 | +35 | 30 | Inv. |
| 4 | LA-1 | 2.5 | 2.5 | 1.0 | 0 | 50 | +28 | 25 | Inv. |
| 5 | LA-1 | 7.5 | 2.5 | 3.0 | 0 | 50 | +32 | 26 | Inv. |
| 6 | LA-1 | 8.75 | 2.5 | 3.5 | 0 | 50 | +75 | 35 | Comp. |
| 7 | LA-1 | 1.25 | 2.5 | 0.5 | 0.1 | 50 | +22 | 20 | Inv. |
| 8 | LA-1 | 1.25 | 2.5 | 0.5 | 0.5 | 50 | +18 | 22 | Inv. |
| 9 | LA-1 | 1.25 | 2.5 | 0.5 | 2 | 50 | +15 | 20 | Inv. |
| 10 | LA-1 | 1.25 | 2.5 | 0.5 | 3 | 50 | +15 | 21 | Inv. |
| 11 | LA-1 | 1.25 | 2.5 | 0.5 | 5 | 50 | +18 | 20 | Inv. |
| 12 | LA-1 | 1.25 | 2;5 | 0.5 | 7 | 50 | +23 | 60 | Inv. |
| 13 | LA-2 | 1.25 | 2.5 | 0.5 | 0.1 | 50 | +23 | 20 | Inv. |
| 14 | LA-2 | 1.25 | 2.5 | 0.5 | 0.5 | 50 | +13 | 13 | Inv. |
| 15 | LA-2 | 1.25 | 2.5 | 0.5 | 2 | 50 | +12 | 10 | Inv. |
| 16 | LA-2 | 1.25 | 2.5 | 0.5 | 3 | 50 | +11 | 9 | Inv. |
| 17 | LA-2 | 1.25 | 2.5 | 0.5 | 5 | 50 | +10 | 11 | Inv. |
| 18 | LA-2 | 1.25 | 2.5 | 0.5 | 7 | 50 | +18 | 55 | Inv. |

As is shown in Table 1, the samples according to the invention are excellent in the variation of the dimension and the repeatability of the dimension compared with the comparative samples.

Example 2

Samples were prepared in the same manner as in Example 1 except that the amount of matting agent contained in the backing protective layer was changed to vary the Smooster value. The samples were evaluated in the same manner as in Example 1. Thus obtained results are shown in Table 2.

As shown in Table 2, samples having the Smooster values within the range of from 100 to 300 mmHg are particularly excellent in the dimension stability among the samples according to the invention.

Example 3

Samples 26, 27 and 28 were prepared in the same manner as Sample 9 in Example except that the composite latexes PL-8, -9 and -10 were used in place of LA-1 in the composition of backing layer. The amount of composite latex is shown in Table 3. The samples were evaluated in the

TABLE 2

| No. | BC layer Latex (LX) Kind | BC layer Latex (LX) (g/m²) | BC layer Gelatin (g/m²) | Lx/Gel ratio | Inorganic particle (g/m²) | Smooster value (mmHg) | Variation of dimension (μm) | Repeatability (μm) | Remarks |
|---|---|---|---|---|---|---|---|---|---|
| 3 | LA-1 | 1.25 | 2.5 | 0.5 | 0 | 50 | +35 | 30 | Inv. |
| 19 | LA-1 | 1.25 | 2.5 | 0.5 | 0 | 100 | +25 | 25 | Inv. |
| 20 | LA-1 | 1.25 | 2.5 | 0.5 | 0 | 150 | +23 | 22 | Inv. |
| 21 | LA-1 | 1.25 | 2.5 | 0.5 | 0 | 200 | +21 | 19 | Inv. |
| 22 | LA-1 | 1.25 | 2.5 | 0.5 | 0 | 300 | +21 | 20 | Inv. |
| 23 | LA-1 | 1.25 | 2.5 | 0.5 | 0 | 400 | +18 | 50 | Inv. |
| 24 | LA-1 | 1.25 | 2.5 | 0.5 | 1 | 150 | +10 | 8 | Inv. |
| 25 | LA-2 | 1.25 | 2.5 | 0.5 | 1 | 150 | +3 | 5 | Inv. |

same manner as in Example 1. Thus obtained results are shown in Table 3.

TABLE 3

| | BC layer | | | | Inorganic | Smooster | Variation of | Repeat- | |
|---|---|---|---|---|---|---|---|---|---|
| | Latex (LX) | | Gelatin | Lx/Gel | particle | value | dimension | ability | |
| No. | Kind | (g/m$^2$) | (g/m$^2$) | ratio | (g/m$^2$) | (mmHg) | ($\mu$m) | ($\mu$m) | Remarks |
| 26 | PL-8 | 1.25 | 2.5 | 0.5 | 1.25 | 50 | +10 | 7 | Inv. |
| 27 | PL-9 | 1.25 | 2.5 | 0.5 | 2.50 | 50 | +7 | 7 | Inv. |
| 28 | PL-10 | 1.25 | 2.5 | 0.5 | 5.00 | 50 | +5 | 3 | Inv. |

As is shown in Table 3, the samples according to the invention are excellent in the dimension stability.

What is claimed is:

1. A silver halide photographic light-sensitive material comprising a support, a silver halide emulsion layer provided on one side of the support, and a non-light-sensitive hydrophilic colloid layer provided on the other side of the support, in which the non-light-sensitive hydrophilic colloid layer comprises a polymer latex and a gelatin in a weight ratio of the polymer latex to gelatin of from 0.5 to 3.0, and wherein the outermost surface of the hydrophilic colloid layer coated side of the light-sensitive material has a Smooster value of from 25 to 300 mmHg.

2. The light-sensitive material of claim 1, wherein the non-light-sensitive hydrophilic colloid layer contains an inorganic particle in an amount of from 0.1 to 5.0 g/m$^2$.

3. The light-sensitive material of claim 1, wherein the polymer latex contained in the non-light-sensitive hydrophilic colloid layer is a composite latex comprising an inorganic particle and a hydrophobic polymer and the amount of the composite latex is from 0.1 to 5.0 g/m$^2$.

* * * * *